US006168038B1

(12) United States Patent
Fischer

(10) Patent No.: US 6,168,038 B1
(45) Date of Patent: Jan. 2, 2001

(54) STACKABLE CONTAINER

(76) Inventor: Johannes Fischer, Weiherstrasse 3, D-91367, Weissenohe (DE)

( * ) Notice: Under 35 U.S.C. 154(b), the term of this patent shall be extended for 0 days.

(21) Appl. No.: 09/462,806

(22) PCT Filed: Jul. 8, 1998

(86) PCT No.: PCT/DE98/01878

§ 371 Date: Jan. 14, 2000

§ 102(e) Date: Jan. 14, 2000

(87) PCT Pub. No.: WO99/03744

PCT Pub. Date: Jan. 28, 1999

(30) Foreign Application Priority Data

Jul. 14, 1997 (DE) ..... 197 30 063

(51) Int. Cl.[7] ..... B65D 43/00
(52) U.S. Cl. ..... 220/4.01; 220/345.3
(58) Field of Search ..... 220/4.01, 345.2, 220/345.3, 345.4

(56) References Cited

U.S. PATENT DOCUMENTS

| | | | | |
|---|---|---|---|---|
| 2,532,083 | | 11/1950 | Brenner . | |
| 4,174,034 | * | 11/1979 | Hoo | 220/345.3 |
| 4,401,210 | * | 8/1983 | Anjou | 220/345.3 |
| 5,012,922 | * | 5/1991 | Nehl | 220/345.3 |
| 5,285,897 | * | 2/1994 | Ozaki | 220/345.3 |
| 5,480,249 | * | 1/1996 | Kageyama et al. | 220/345.3 |
| 5,577,629 | * | 11/1996 | Roslen | 220/345.3 |

FOREIGN PATENT DOCUMENTS

| | | |
|---|---|---|
| 11 56 019 | 10/1963 | (DE) . |
| 93 08 410 | 8/1993 | (DE) . |
| 43 08 861 | 4/1996 | (DE) . |
| 42 29 802 | 9/1996 | (DE) . |
| 0 236 514 | 9/1987 | (EP) . |
| 2 118 144 | 10/1983 | (GB) . |
| 2 250 504 | 6/1992 | (GB) . |

* cited by examiner

*Primary Examiner*—Joseph M. Moy
(74) *Attorney, Agent, or Firm*—Venable; Gabor J. Kelemen

(57) ABSTRACT

The invention concerns a stackable container consisting of a base box (1) and a lid (18) capable of being transported open in freight traffic and also filled and emptied once it has been stacked, and also of being closed and re-opened. For this purpose, the lid (18) consists of a cover plate (21) and a front wall (19) placed at right angles, said cover plate (21) is inserted, from the base box (1) open front face, into a peripheral groove (31) of the top edge, the base plate (4), has on its front ridge a supporting rim (10) provided with a ribbing (34) oriented upwards, just before reaching its closing position, the lid (18) being located inside the groove (31) widened in the side walls (2) rises slightly and when it drops after reaching its closing position, a projecting part (33) arranged on the inner front wall (19) lower edge (29) is engaged in the supporting rim (10) ribbing (34).

15 Claims, 2 Drawing Sheets

STACKABLE CONTAINER

Figure 1:
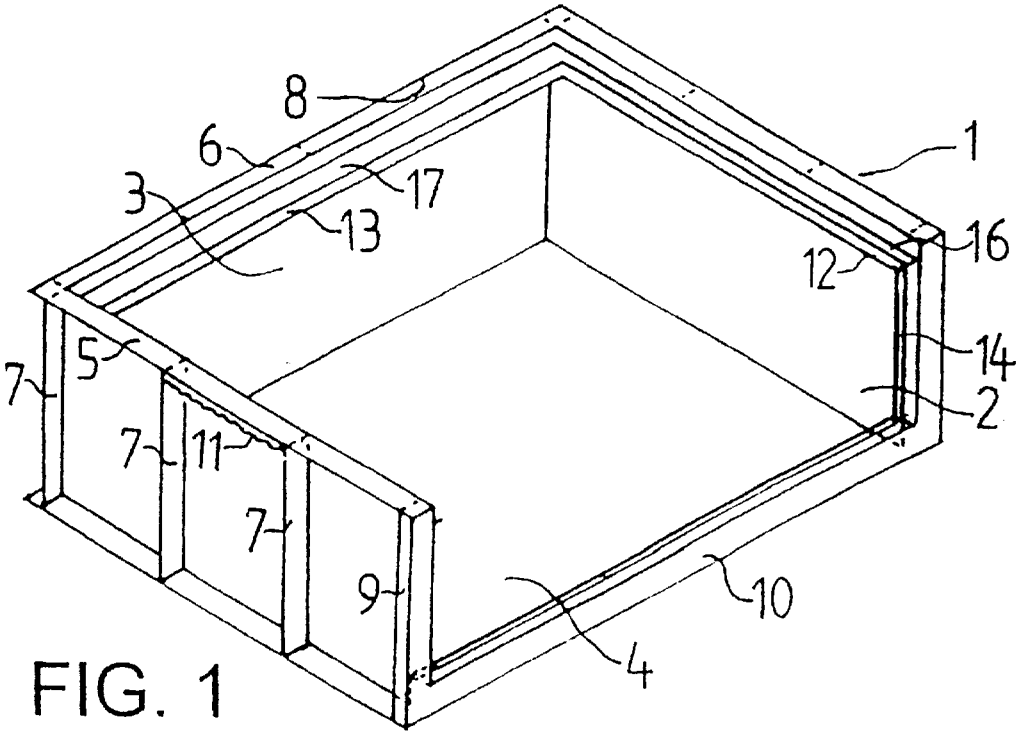

The invention relates to a stackable, four-sided transport container, comprising a base box and a lid, the base box having a floor plate with two side walls that are mounted at a right angle, and a rear wall mounted at a right angle, and a base strip that extends around the periphery of the floor plate and is recessed with respect to the outside edges of the plate, and whose outside dimensions correspond to the inside dimensions of the base box at its upper edge.

German patent documents DE 42 29 802 C2 and DE 93 08 410 U1 disclose transport containers comprising a floor with four side walls and a removable lid. One of the side walls has an opening, or is completely omitted; the opening or the open side can be closed by a flap. The floor has a continuous base strip that is recessed with respect to the edge of the floor plate, and therefore can be inserted snugly into a projecting frame at the upper edge of a further transport container. This prevents a lateral displacement of two vertically-stacked containers relative to one another.

In these known containers, the flap that closes the opening or the open side can be opened to allow the stacked transport containers to be filled or emptied.

In many applications, these flaps, which are fixedly mounted to the stacked transport containers, are undesirable because of their unavoidable pivoting area. Furthermore, the functioning ability of moving parts, such as flaps or the like, deteriorates rapidly under rough transport conditions, so repairing or replacing damaged transport containers of this type becomes excessively costly.

On the other hand, storage containers are known, for example from DAS 11 56 019, which have no lid, but solely comprise a floor plate with two side walls that are mounted at approximately right angles, and a rear wall mounted at approximately a right angle, while a front wall of approximately half size is mounted on the floor plate at an angle of about 120°. When stacked, these storage containers are open to the front, above the diagonally-mounted half front wall, and can therefore be filled and emptied when stacked. These storage containers can only be used as transport containers under limited conditions, however, because they cannot be closed with a lid when stacked.

U.S. Pat. No. 2,532,083 further discloses a wooden transport case that is provided for transporting fruits and vegetables by ship; these cases have a lid with an attached front wall, which can be inserted into a groove that extends at the upper edge of the side walls and the rear wall, and has an opening that is oriented toward the inside of the transport case. The inserted lid is not secured in the case by itself, but requires a peg behind the rear wall of the case to secure it. This transport case also cannot be stacked without external holding devices, because their bottom and top sides are completely smooth, so stacked cases slide immediately at the exertion of even the smallest lateral force.

It is the object of the invention to provide a stackable, four-sided transport container of the type mentioned at the outset, which can be transported in open freight traffic, filled and emptied easily and efficiently, and closed and re-opened without auxiliary devices.

In accordance with claim 1, this object is accomplished in that a) the lid comprises a cover plate and a front wall that is mounted to it at a right angle;

b) the cover plate can be inserted from the open front side of the base box into a continuous groove extending at the periphery in the upper edge region of the side walls and the rear wall and oriented toward the interior of the base box;

c) at its front edge, the floor plate has a support strip provided with an upward-oriented groove;

d) shortly before the closed position is reached, the lid can be raised by a small amount inside the groove, which is expanded in the region of the side walls; and e) after the closed position has been reached and the lid has been lowered again, a projection formed onto the lower edge of the front wall engages the groove of the support strip.

The dependent claims disclose further advantageous embodiments of the invention.

The advantages that can be attained with the invention are that the stackable, four-sided transport container can be transported in open freight traffic, filled easily and efficiently when stacked, sealed with commercially-available adhesive strips, and re-opened without auxiliary devices. It can be produced inexpensively and easily used for multiple journeys. Because of its tightly-fitting connections, it can be stacked well, both in transport and in storage. The risk of damage or loss is low, because no moving or loose parts are used.

Figure 2:
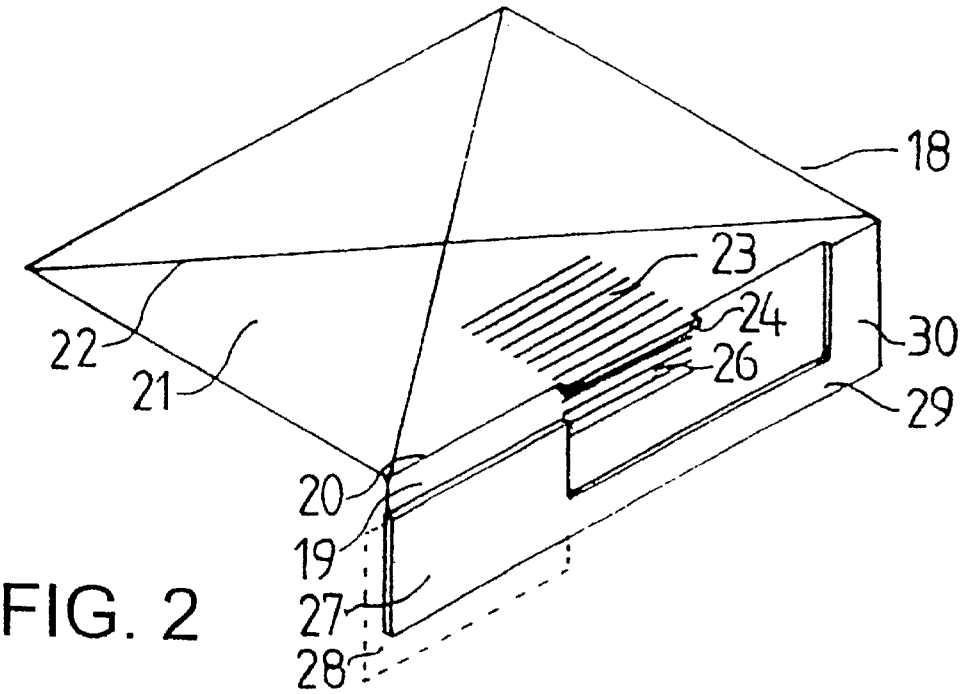
Figure 3:
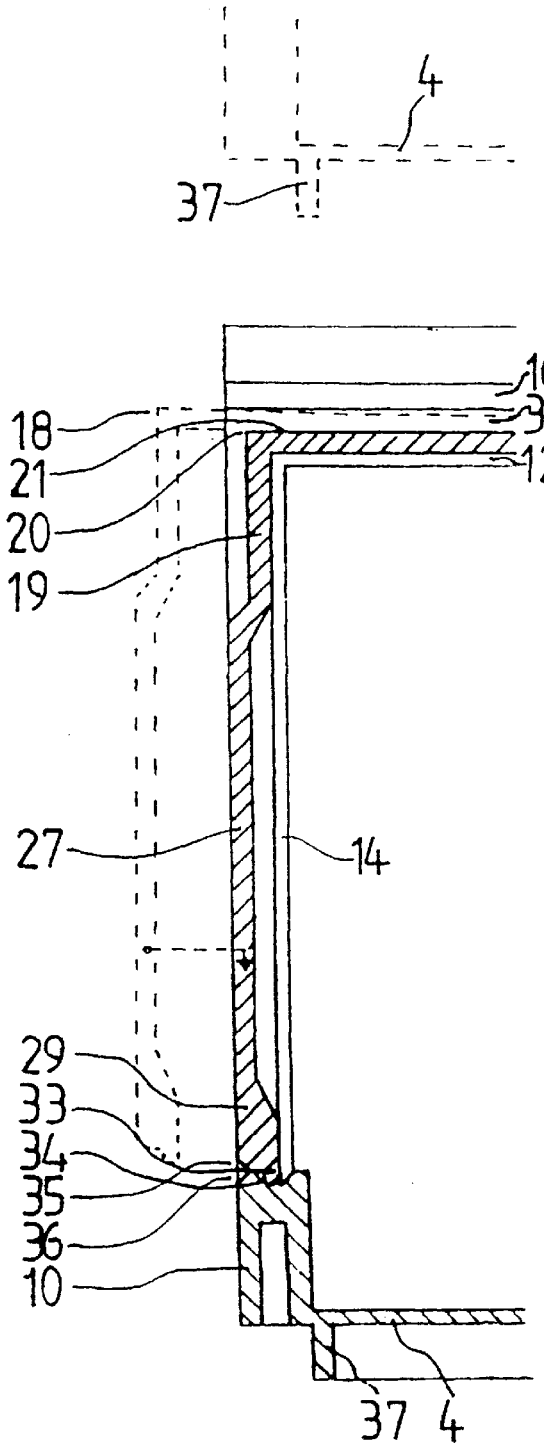
Figure 4:
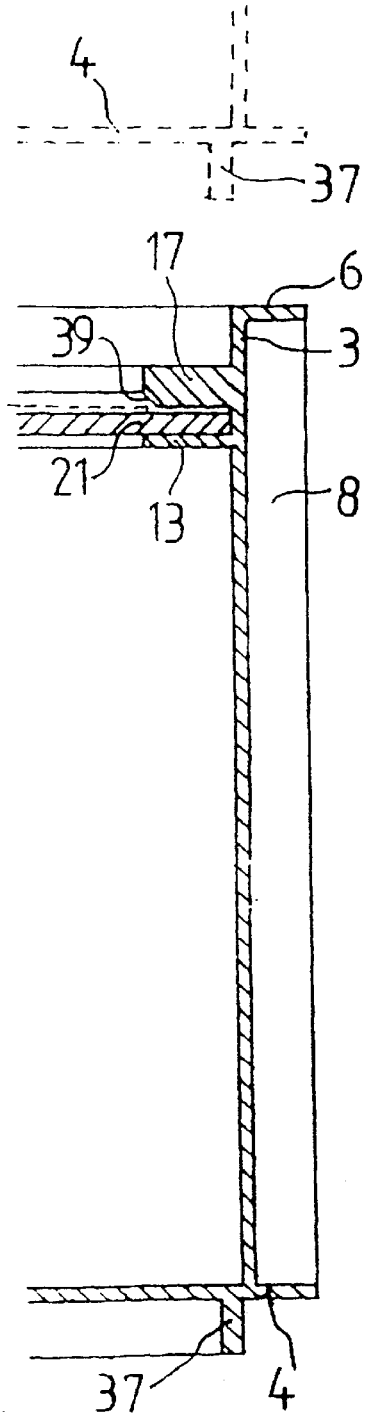

An embodiment of the invention is illustrated in the drawing and explained in detail below. Shown are in:

FIG. 1 the base box of a transport container, in an isometric representation;

FIG. 2 the lid of the transport container, in an isometric representation;

FIG. 3 the front wall of the transport container, in a section near a side wall; and FIG. 4 the rear wall of the transport container, in a section.

The transport container of the invention comprises a base box 1 according to FIG. 1, and a lid 18 according to FIG. 2.

The base box 1 comprises two side walls 2, a rear wall 3 and a floor plate 4. The side walls 2 and the rear wall 3 are provided with outwardly-oriented, horizontal, upper borders 5, 6, and vertical webs 7, 8, which increase stability. Two vertical front webs 9 extending at the front side of the base box 1 and a support strip 10 secured to the floor plate 4 are exposed to high stress, and are therefore embodied as rectangular prisms or U profiles, as shown in FIG. 3.

On the underside of the borders 5, a wavy profile 11 acting as a gripping aid is mounted between the two central, vertical webs 7 of the side walls 2.

Upper and lower horizontal webs 12, 13, 16, 17 are mounted in the upper region of the side walls 2 and the rear wall 3; these webs extend completely over one of these three walls and face the inside. At the front edge of the side walls 2, the lower horizontal webs 12 continue downward in a respective stop web 14. The upper horizontal webs 16, 17 serve in supporting a further transport container that is stacked on the present one, or in the insertion of a cover plate.

The lid 18 illustrated in FIG. 2 includes a front wall 19 and a cover plate 21, which is fixedly connected to the front wall by way of a perpendicular buckling edge 20, with reinforcing burrs 22 being formed onto the plate, along its diagonal. A raised gripping-strip field or grooved field 23 on the cover plate 21 continues as a forward gripping-strip field or grooved field 26 after a gripping latch 24 that is aligned with the front from the base plane of the cover plate 21, and a gripping indentation located under the latch on the front wall 19. The lid 18 is provided with a raised surface 27 at its front wall 19, the surface being supplemented in the inserted state by the one front web 9 and the support strip 10 to form a complete surface 28, which serves in the affixing of an address label. The lower edge 29 and the one lateral edge 30 of the front wall 19 are likewise raised; the lower edge 29 and the support strip 10, and the one lateral edge 30 and the one front web 9, respectively, form an adhesion surface having a width that corresponds to the width of commercially-available self-adhesive labels.

FIGS. 3 and 4 show how the lid closes the base box 1. Here, the cover plate 21 of the lid 18 is slid onto the lower horizontal webs 12 of the side walls 2, and to end the insertion process, the entire lid 18 is lifted slightly with the gripping latch 24, whereby a groove 31, which is formed between the lower horizontal webs 12 and the upper horizontal webs 16, and is wider than the thickness of the cover plate 21, allows sufficient play—as shown in a dashed line in FIG. 3—for a projection 33 located at the lower, reinforced edge 29 of the front wall 19 to extend into a groove 34 at the top side of the support strip 10 after the closed position has been reached and the lid 18 has been lowered again.

The vertical stop web 14 at the side walls 2, against which the inward-oriented surface of the front wall 19 rests at the end of the insertion process, prevents the front wall 19 from buckling during the adhesion of adhesive strips that secure the lid 18, and/or address labels. Chamfers 35, 36 are provided at the outward-oriented side of the lower edge 29 of the front wall 19, and at the outward-oriented, upper edge of the support strip 10 of the base box 1, forming cutting notches for easier separation of the affixed adhesive strips or address labels.

FIGS. 3 and 4 illustrate in a dashed line how a transport container having the same design as the present one is placed onto the inward-oriented, upper horizontal web 16 vertically from above, without a seam with the base strip 37 being maintained. The standing stability of the stack is further increased by the formation of a flange between the upper border 5 of the base box 1 and the floor plate 4 of the base box 1 placed on it.

What is claimed is:

1. A stackable, four-sided transport container, comprising a base box (1) and a lid (18), the base box (1) having a floor plate (4) with two side walls (2) that are mounted a right angle, and a rear wall (3) mounted at a right angle, the lid (18) comprising a cover plate (21) and a front wall (19) that is mounted at a right angle, and with the cover plate (21) being inserted from the open front side of the base box (1) into a continuous groove (31) that extends around the periphery of the upper edge region of the side walls (2) and the rear wall (3) and is oriented toward the interior of the base box (1), characterized in that a) the floor plate (4) has a support strip (10) at its front edge, the strip preferably being embodied as one of a rectangular prism and a U profile and having an upward-oriented groove (34);

b) shortly before the closed position is reached, the lid (18) can be rained by a small amount inside the groove (31), which is expanded in the region of the side walls (2); and c) after the closed position has been reached and the lid (18) has been lowered again, a projection (33) formed onto the lower edge (29) of the front wall (19) engages the groove (34) of the support strip (10);

d) the front side of the base box (1) has two vertical front webs (9), which are embodied as one of rectangular prisms and U profiles; and e) the lid (18) is provided with a raised surface (27) at its front wall (19), the surface being supplemented in the inserted state by the one front web (9) and the support strip (lo) to form a complete surface (28), which serves in the affixing of an address label.

2. The transport container according to claim 1, characterized in that a base strip (37) that extends around the periphery of the floor plate (4) and is recessed with respect to the outside edges of the plate is mounted to the plate, the outside dimensions of the strip corresponding to the inside dimensions of the base box (1) at its upper edge.

3. The transport container according to claim 1, characterized in that the lower edge (29) and a lateral edge (30) of the front wall (19) are raised, and can be used as adhesion surfaces, and the lower edge (29) and the support strip (10), and the one lateral edge (30) and the one front web (9), respectively, form an adhesion surface having a width that corresponds to the width of commercially-available self-adhesive labels.

4. The transport container according to claim 3, characterized in that chamfers (35, 36) are provided at the outward-oriented side of the lower edge (29) of the front wall (19), and at the outward-oriented, upper edge of the support strip (10) of the base box (1).

5. The transport container according to claim 1, characterized in that the peripheral groove (31) is formed by upper horizontal webs (16, 17) mounted to the periphery of the side walls (2) and the rear wall (3), and lower horizontal webs (12, 13), with the lower horizontal webs (12) continuing downward in a respective stop web (14) at the inward-oriented surface of the front wall (19) in the inserted state.

6. The transport container according to claim 5, characterized in that the upper horizontal webs (16, 17) serve for supporting the base strip (37) of a further transport container stacked on the present one.

7. The transport container according to claim 1, characterized in that the side walls (2) and the rear wall (3) are provided with outward-oriented, horizontal, upper borders (5, 6).

8. The transport container according to claim 1, characterized in that one of a raised gripping-strip field and grooved field (23) on the cover plate (21) continues as one of a forward gripping-strip field and grooved field (26) after a gripping latch (24) that is aligned with the front from the base plane of the cover plate (21), and a gripping indentation located under the latch on the front wall (19).

9. The transport container according to claim 1, characterized in that the base box (1), with the floor plate (4), the side walls (2), the rear wall (3), the base strip (37), the support strip (10) and all of the other formed-on elements, and the lid (18), are produced in one piece with the cover plate (21), the front wall (19) and all further formed-on elements.

10. The transport container according to claim 1, characterized in that at least one of the base box (1) and the lid (18) is made of thermoplastic plastic.

11. The transport container according to claim 5, characterized in that the upper horizontal webs (16, 17) serve for insertion of a cover plate.

12. The transport container according to claim 1, characterized in that the side walls (2) are provided with outward-oriented, horizontal, upper borders (5, 6).

13. The transport container according to claim 1, characterized in that the rear wall (3) is provided with outward-oriented, horizontal, upper borders (5, 6).

14. The transport container according to claim 1, characterized in that the base box (1), with the floor plate (4), the side walls (2), the rear wall (3), the base strip (37), the support strip (10) and all of the other formed-on elements are produced in one piece with the cover plate (21), the front wall (19) and all further formed-on elements.

15. The transport container according to claim 1, characterized in that the lid (18) is produced in one piece with the cover plate (21), the front wall (19) and all further formed-on elements.

* * * * *